US006522759B1

(12) United States Patent
Mori

(10) Patent No.: US 6,522,759 B1
(45) Date of Patent: Feb. 18, 2003

(54) SPEAKER

(75) Inventor: Takan Mori, Osaka-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/219,278

(22) Filed: Dec. 22, 1998

(30) Foreign Application Priority Data

Dec. 26, 1997 (JP) ..... 9-360055

(51) Int. Cl.[7] ..... H04R 25/00

(52) U.S. Cl. ..... 381/150; 381/173; 381/338; 381/345; 381/162; 381/351; 181/160; 181/171; 181/182; 181/189

(58) Field of Search ..... 381/173, 372, 381/373, 337, 353, 338, 351, 345, 346, 162; 181/160, 166, 171, 182, 183, 189, 173

(56) References Cited

U.S. PATENT DOCUMENTS 4,076,097 A * 2/1978 Clarke
4,278,851 A 7/1981 Takaya
4,379,211 A * 4/1983 Joscelyn
4,413,198 A 11/1983 Bost
4,430,529 A 2/1984 Nakagawa et al.
4,439,644 A * 3/1984 Bruney
4,549,631 A * 10/1985 Bose
4,875,546 A * 10/1989 Krnan
4,949,387 A 8/1990 Andert et al.
5,025,885 A * 6/1991 Froeschle
5,092,424 A * 3/1992 Schreiber
5,150,417 A * 9/1992 Stahl
5,184,332 A 2/1993 Butler
5,198,624 A * 3/1993 Paddock
6,169,811 B1 * 1/2001 Croft

* cited by examiner

*Primary Examiner*—Curtis Kuntz
*Assistant Examiner*—Dionne N. Harvey
(74) *Attorney, Agent, or Firm*—Keating & Bennett, LLP

(57) ABSTRACT

A reduced-size speaker for generating sound waves in wide low frequency audio region includes a cylindrical main body which is open at the top and bottom surfaces, a top lid being provided on the top surface of the main body and a circular ring-shaped base, which has a hole in its center, being provided on the bottom surface of the main body. A circular sound pipe is provided approximately in the center of the top lid and extends from the upper surface of the main body through the inside of the main body. A disc-like film is provided over the opening of the hole of the base, which is located at the outer side with respect to the main body, the disc-like film being held between the base and a circular ring-shaped bottom lid. A disc-like sound generator is provided in the opening of the hole of the base, which is located at the inner side with respect to the main body, with a circular ring-shaped damper provided in between. A plurality of supporting members are attached to the bottom lid in order to mount the speaker on a mounting surface.

18 Claims, 3 Drawing Sheets

SPEAKER

BACKGROUND OF THE INVENTION

1. Field of the Invention

The present invention relates to a speaker, and more particularly, to a speaker for generating sound waves in a low frequency audio region using a sound generator including piezoelectric ceramics.

2. Description of the Related Art

A conventional speaker having a sound generator including piezoelectric ceramics has been disclosed in Japanese Unexamined Utility Model Publication No. 60-108098. This will be explained by referring to the drawings.

FIG. 6 shows a speaker 100 including a case 101. The case 101 includes a main body 102 and a lid 103. A piezoelectric resonator 104, which forms a sound generator, is provided at the connection between the main body 102 and the lid 103. Then, a sound hole 105 and a sound pressure adjusting tube 106 are provided with the lid 103, whereby the inner portion of the lid 103 becomes a resonant box 107. The sound pressure properties of the speaker 100 are adjusted and controlled by adjusting the length and diameter of the sound pressure adjusting tube 106.

However, an object of the conventional speaker was to make the sound pressure properties smooth, and consequently, it was difficult to obtain sufficient sound pressure having a wide band of frequencies, and particularly having a wide band of low frequencies. Furthermore, the main parts functioned especially poorly, and resulted in an increase of the overall size of the speaker.

SUMMARY OF THE INVENTION

In order to solve the above problems, preferred embodiments of the present invention provide a speaker which has a very small-size and generates excellent quality sound at an expanded low frequency audio region.

According to one preferred embodiment of the present invention, a speaker includes a main body, at least a bottom surface of the main body being open, a film provided on the bottom surface of the main body, a sound pipe extending from a top surface of the main body toward the inside of the main body, and a plate-like sound generator provided inside of the main body and arranged substantially parallel to the top surface and the bottom surface, the sound generator including piezoelectric ceramics.

Furthermore, the sound pipe is preferably bent or divided within the main body.

As a result, the speaker according to preferred embodiments of the present invention radiates low frequency sound waves having two resonant points, the two resonant points being low frequency sound waves radiated from a sound pipe and low frequency sound waves radiated through a film, and therefore, the low frequency range of the totality of radiated sound waves is significantly increased and expanded.

Furthermore, by bending the sound pipe or dividing the sound pipe within the main body, it is possible to obtain a sound pipe having sufficient length while reducing a height or vertical dimension of the speaker.

Other features and advantages of the present invention will become apparent from the following description of preferred embodiments of the present invention which refers to the accompanying drawings.

DETAILED DESCRIPTION OF PREFERRED EMBODIMENTS

Preferred embodiments of the present invention are described below with reference to the accompanying drawings.

Figure 1:
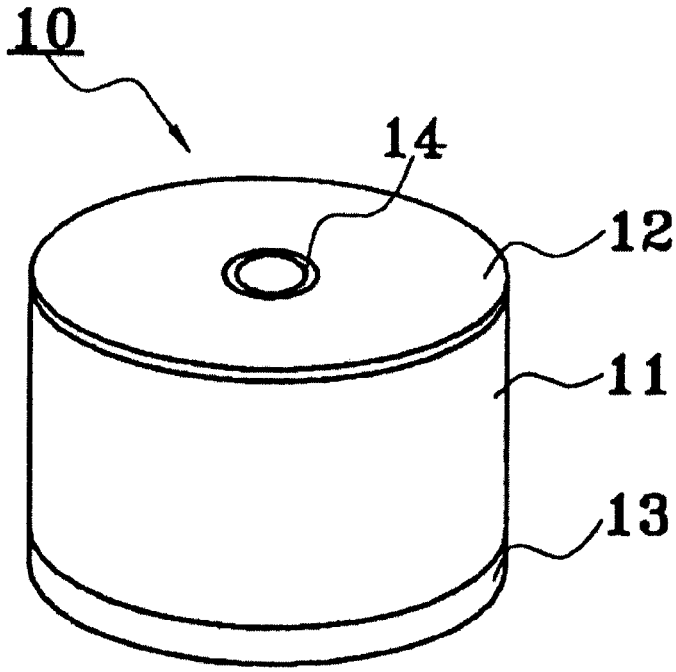
FIG. 1 is a perspective view from the upper surface illustrating the construction of a speaker according to a preferred embodiment of the present invention.
Figure 2:
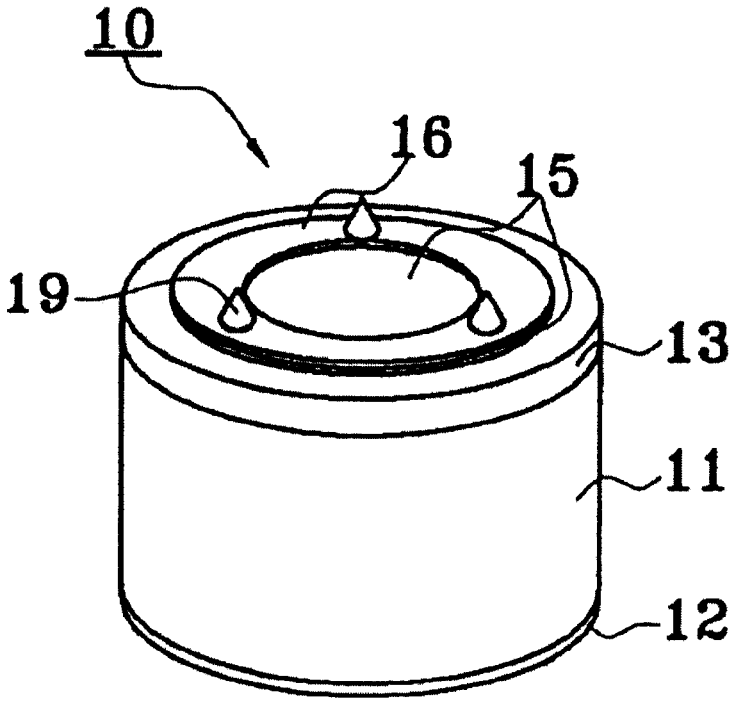
FIG. 2 is a perspective view from the bottom surface illustrating the construction of a speaker according to the preferred embodiment of FIG. 1.
Figure 3:
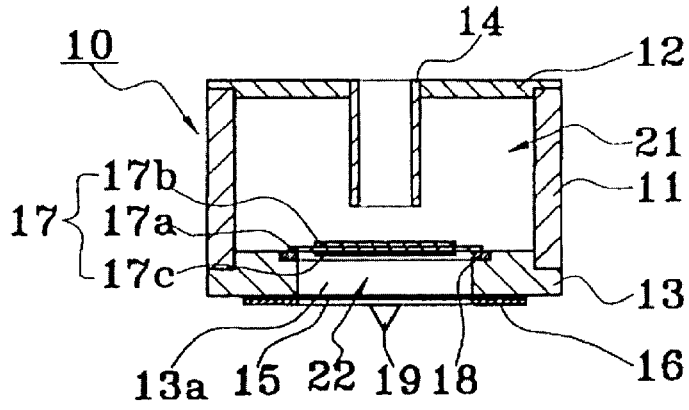
FIG. 3 is an upper surface central horizontal sectional view of the speaker according to the preferred embodiment of FIG. 1.

In FIGS. 1 to 3, a speaker 10 has a substantially cylindrical main body 11. The main body 11 is open at the top surface and the bottom surface thereof. A top lid 12 is provided on the top surface of the main body 11 and a substantially circular ring-shaped base 13, which has a hole 13*a* located approximately at its center, is provided on the bottom surface of the main body 11. A substantially circular sound pipe 14 is provided approximately at the center of the top lid 12 and extends from the upper surface of the main body 11 through the inside of the main body 11. A disc-like film 15 is provided over the opening of the hole 13*a* of the base 13, which is located at the outer side with respect to the main body 11, the disc-like film 15 being held between the base 13 and a substantially circular ring-shaped bottom lid 16. Furthermore, a disc-like sound generator 17 is provided in the opening of the hole 13*a* of the base 13, which is located at the inner side with respect to the main body 11, with a substantially circular ring-shaped damper provided in between. Then, a plurality of substantially conical supporting members 19 are attached to the bottom lid 16 in order to mount the speaker 10 on a mounting surface such that the film 15 and bottom surface of the base 13 is spaced from the mounting surface so as to allow sound waves to be emitted through the opening of the speaker covered by the film 15.

The main body 11, the top lid 12, the base 13, the sound pipe 14 and the bottom lid 16 each are preferably formed of material generally used for a speaker cabinet, such as, for instance, metal, plastic or wood, with a material of high density being more preferable.

The sound generator 17 includes a metal disc-like resonator 17*a*, and, as resonance sources, disc-like piezoelectric ceramic elements 17*b* and 17*c* are secured substantially in the approximate centers of both main surfaces of the resonator 17*a*, each ceramic element 17*b* and 17*c* being positioned in a concentric circle with respect to the resonator 17*a* in a bimorph structure.

The film 15 preferably includes an elastic rubber sheet and is fastened to the base 13 via the bottom lid 16. Furthermore, the damper 18 includes a rubber ring and is secured preferably via adhesive to the base 13 and the sound generator 17, so that the speaker 10 is partitioned into a first cavity 21 on the main body 11 side and a second cavity 22 on the base 13 side.

In the speaker 10 having the above-described novel structure, when one of the channel signals of a stereo signal is input to the sound generator 17, the sound generator 17 vibrates, causing sound waves to be generated from the sound generator 17 into the first cavity 21 and the second cavity 22.

At that time, sound waves inside the first cavity 21 resonate in the sound pipe 14 and in the first cavity 21. Low audio frequency sound waves which are accentuated by this resonance are radiated from the sound pipe 14 to the outside of the speaker 10. Furthermore, sound waves inside the second cavity 22 are attenuated at middle to high audio frequencies by the film 15, so that only low audio frequency sound waves are accentuated and pass through the film 15 to outside of the speaker 10. Then, since the sound waves radiated from the sound pipe 14 and the sound waves radiated from the film 15 have different resonance points at low audio frequencies, the totality of sound waves radiated from the speaker covers a wide band of low audio frequencies.

Here, using Helmholtz's Law, the resonant frequency for the first cavity 21 can be expressed by the following equation:

$$f=c/2p[pr2/\{V(L+1.3r)\}]^{1/2}$$

where f represents the resonant frequency, c represents sound speed, V represents volume of the first cavity 21, L is the length of the sound pipe 14, and r represents the radius of the opening in the sound pipe 14.

As shown by this equation, there are three conditions for lowering the resonant frequency f, that is, increasing the length of the sound pipe 14, reducing the radius of the sound pipe 14, and increasing the volume of the first cavity 21. However, it is not desirable to reduce the radius of the sound pipe 14, since this reduces the sound pressure of sound waves radiating from the sound pipe 14. Furthermore, it is not desirable to increase the volume of the first cavity 21, since this increases the size of the speaker 10 itself.

Therefore, by lengthening the sound pipe 14 within the range of the size of the first cavity 21, the resonant frequency can be shifted toward the low frequency side.

Figure 4:
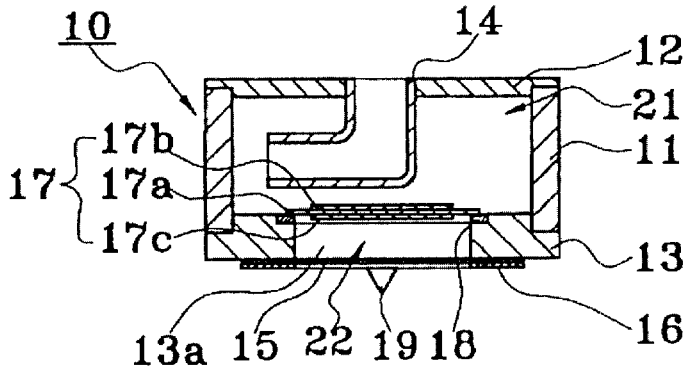
FIG. 4 is an upper surface central horizontal sectional view of the construction of a speaker according to another preferred embodiment of the present invention.
Figure 5:
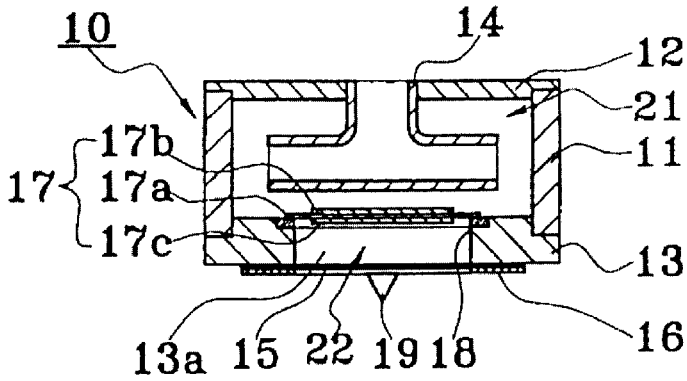
FIG. 5 is an upper surface central horizontal sectional view of the construction of a speaker according to yet another preferred embodiment of the present invention.
Figure 6:
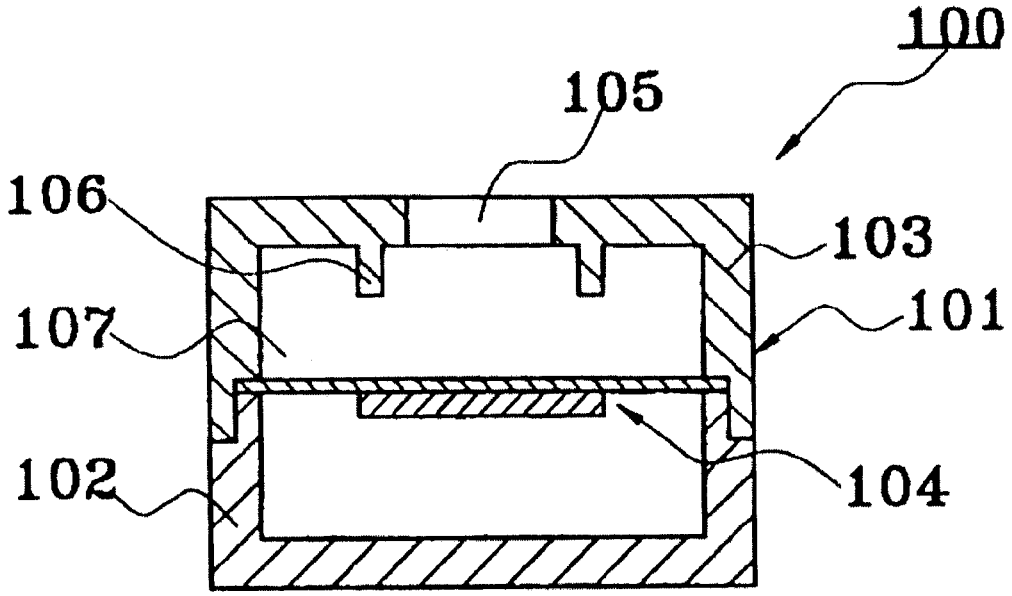
FIG.6 PRIOR ART
FIG. 6 is a cross-sectional view of the constitution of a conventional speaker.

For instance, as shown in FIG. 4, the sound pipe 14 may be bent to form an approximate L-shape inside the first cavity 21, or as shown in FIG. 5, the sound pipe 14 may be divided so as to form an approximate T-shape inside the first cavity 21. Since the other parts of the speaker construction in these preferred embodiments are the same as the speaker 10 of FIG. 3, the same reference numerals are used and repetitive explanation is omitted.

In the speaker construction described above, the length of the sound pipe 14 can be increased, the resonant frequency of the first cavity 21 can be shifted toward the low audio frequency side, whereby sound waves from the sound pipe 14 are radiated at even lower audio frequency regions.

Furthermore, by bending the sound pipe 14 or dividing the sound pipe, it is possible to reduce the height of the speaker 10, enabling the speaker 10 to be much smaller.

In the preferred embodiments described above, the main body 11, the top lid 12, the base 13, the sound pipe 14 and the bottom lid 16 are separate bodies, but these separate bodies may be molded so as to form a single body.

Furthermore, when a sound-absorbing material, such as a glass wall, is provided inside the first cavity 21 or the second cavity 22, the generated sound waves are attenuated by absorption of sound waves in middle to high frequency regions, thereby further accentuating the low frequency audio regions of sound waves radiated from the sound pipe 14 and the film 15.

Furthermore, the shape of the main body 11 is not restricted to a cylinder, and may be a square tube or other geometrical shape. Similarly, the other constituent elements, such as the base 13 and the sound generator 17, may be made angular in correspondence with the shape of the main body 11.

Furthermore, the constitution of the sound generator 17 is not restricted to a sound generator using a piezoelectric ceramic element with a bimorph structure, but may be a sound generator using a piezoelectric ceramic element arranged to have a unimorph structure, or a sound generator using a piezoelectric ceramic element having a laminated piezoelectric body including three or more ceramic layers.

As explained above, the speaker of preferred embodiments of the present invention radiates low frequency audio region sound waves having two resonant points, these two resonant points being low frequency audio region sound waves radiated from a sound pipe and low frequency audio region sound waves radiated through a film. As a result, the low frequency audio region of the combined radiated sound waves is significantly expanded and increased, thereby improving low frequency audio sound pressure in a wide low frequency audio region.

Furthermore, it is possible to obtain a sound pipe having a significantly increased length by bending the sound pipe or dividing the sound pipe within the main body. Consequently, it is possible to shift the resonant frequency of generated sound waves toward the low frequency side, widen the low frequency band in which the sound waves are to be generated, and in addition, reduce the height of the speaker,, enabling the speaker to have a very small size.

While the invention has been particularly shown and described with reference to preferred embodiments thereof, it will be understood by those skilled in the art that the forgoing and other changes in form and details may be made therein without departing from the spirit of the invention.

What is claimed is:

1. A speaker to be mounted on a mounting surface, comprising:

a main body including a top surface and a bottom surface, at least the bottom surface of said main body being open;

a film disposed at the bottom surface of the speaker;

a sound pipe extending from the top surface of said main body toward the inside of said main body;

a sound generator provided inside said main body and arranged substantially parallel to said top surface and said bottom surface, said sound generator including piezoelectric ceramics; and a plurality of supporting members provided at the bottom surface of the speaker; wherein said film is arranged to face and be spaced from the mounting surface by the plurality of supporting members.

2. The speaker according to claim 1, wherein said sound pipe is bent within said main body.

3. The speaker according to claim 1, wherein said sound pipe is divided within said main body.

4. The speaker according to claim 1, wherein said top surface includes an opening connected to said sound pipe for emitting sound waves through said opening.

5. The speaker according to claim 1, wherein said film includes a rubber sheet.

6. The speaker according to claim 1, further comprising a base attached to said main body and including an opening disposed in operative communication with the open bottom surface of the main body.

7. The speaker according to claim 6, wherein the film covers the opening of said base at a bottom surface of the base.

8. The speaker according to claim 6, wherein the sound generator is disposed across the opening of said base at a top surface of the base.

9. The speaker according to claim 6, further comprising a substantially circular ring-shaped bottom lid, the film being located outside of the main body and being held between the base and the substantially circular ring-shaped bottom lid.

10. The speaker according to claim 1, wherein the sound generator includes a metal disc resonator and piezoelectric ceramic elements disposed at the approximate centers of both main surfaces of the metal disc resonator so as to define a bimorph structure.

11. The speaker according to claim 6, wherein the speaker is partitioned into a first cavity on a side of the main body and a second cavity on a side of the base.

12. The speaker according to claim 11, wherein sound waves inside of the second cavity are attenuated at middle to high audio frequencies by the film so that only low frequency sound waves are transmitted through the film to outside of the speaker.

13. The speaker according to claim 1, wherein the speaker radiates low frequency sound waves having two resonant points including low frequency sound waves radiated from the sound pipe and low frequency sound waves radiated through the film.

14. A speaker to be mounted on a mounting surface, comprising:

a main body including a top surface and a bottom surface, the top and bottom surfaces including openings for emitting sound therefrom;

a film disposed at the bottom surface of the speaker;

a sound pipe extending from the top surface of said main body toward the inside of said main body;

a sound generator provided inside said main body and arranged substantially parallel to said top surface and said bottom surface; and a plurality of supporting members provided at the bottom surface of the speaker; wherein the speaker radiates low frequency sound waves having two resonant points including low frequency sound waves radiated from the sound pipe and low frequency sound wave radiated through the film; and said film is arranged to face and be spaced from the mounting surface by the plurality of supporting members.

15. The speaker according to claim 14, wherein said sound pipe is bent within said main body.

16. The speaker according to claim 14, wherein said sound pipe is divided within said main body.

17. A speaker to be mounted on a mounting surface, comprising:

a main body including a top surface and a bottom surface, the top and bottom surfaces including openings for emitting sound therefrom;

a film disposed at the bottom surface of the speaker;

a sound pipe extending from the top surface of said main body toward the inside of said main body;

a sound generator provided inside said main body and arranged substantially parallel to said top surface and said bottom surface; and a plurality of supporting members provided at the bottom surface of the speaker; wherein the speaker is partitioned into a first cavity on a side of the main body and a second cavity on a side of the base and sound waves generated inside of the second cavity are attenuated at middle to high audio frequencies by the film so that only low frequency sound waves are transmitted through the film to outside of the speaker; and said film is arranged to face and be spaced from the mounting surface by the plurality of supporting members.

18. The speaker according to claim 17, wherein the speaker radiates low frequency sound waves having two resonant points including low frequency sound waves radiated from the sound pipe and low frequency sound waves radiated through the film.

* * * * *